US006353165B1

(12) United States Patent
Chiu et al.

(10) Patent No.: US 6,353,165 B1
(45) Date of Patent: Mar. 5, 2002

(54) STRING INSTRUMENT WITH PROTECTIVE STRING CAP

(75) Inventors: Bernard K. Chiu, Wellesley; Marc B. Harris, W. Newton, both of MA (US); William Hester, Middletown, CT (US); Mark S. Izen, Chestnut Hill, MA (US)

(73) Assignee: First Act, Inc., Needham, MA (US)

( * ) Notice: Subject to any disclaimer, the term of this patent is extended or adjusted under 35 U.S.C. 154(b) by 0 days.

(21) Appl. No.: 09/522,887

(22) Filed: Mar. 10, 2000

(51) Int. Cl.[7] ..... G10D 3/14
(52) U.S. Cl. ..... 84/304; 84/305
(58) Field of Search ..... D17/20; 84/304, 84/305, 297 R, 312 R

(56) References Cited

U.S. PATENT DOCUMENTS 4,030,399 A * 6/1977 Grottola ..... 84/304
5,627,331 A * 5/1997 Devitrysmith ..... 84/304
D384,094 S * 9/1997 DeFord ..... D17/20

* cited by examiner

*Primary Examiner*—Robert E. Nappi
*Assistant Examiner*—Kim Lockett
(74) *Attorney, Agent, or Firm*—John E. Toupal; Harold G. Jarcho

(57) ABSTRACT

A string instrument including a body; a headstock; a neck extending between the body and the headstock; and a plurality of tuning mechanisms retained by the headstock and each having a stem with a tuning end and a connection end. Also included are a plurality of strings each having one end connected to the body and an opposite end connected to a different connection end; and a cover covering each connection end and shaped and arranged to prevent physical access to the opposite end connected thereto.

22 Claims, 4 Drawing Sheets

STRING INSTRUMENT WITH PROTECTIVE STRING CAP

BACKGROUND OF THE INVENTION

String instruments such as acoustic and electric guitars are widely used both for personal enjoyment and entertainment. Although string instruments generally are a source of enjoyment, the strings employed to produce musical sound occasionally can be troublesome. Ends of the strings are attached to tuning stems which can be rotated to adjust string tension and affect pitch of the instrument. The sharp free ends of the strings are exposed and, therefore, can inflict personal injury when contacted by users of the instrument. In addition, the free ends are somewhat unattractive and thereby degrade the overall appearance of the instrument.

The object of this invention, therefore, is to provide an improved, more attractive string instrument which reduces the potential for personal injury during its use.

SUMMARY OF THE INVENTION

The invention is a string instrument including a body; a headstock; a neck extending between the body and the headstock; and a plurality of tuning mechanisms retained by the headstock and each having a stem with a tuning end and a connection end. Also included are a plurality of strings each having one end connected to the body and an opposite end connected to a different connection end; and a cover covering each connection end and shaped and arranged to prevent physical access to the opposite end connected thereto. The cover prevents inadvertent personal injury by the covered opposite ends of the strings.

According to one feature of the invention, the cover includes a base portion secured to the headstock, and a cap portion movable relative to the base portion between a closed position covering the connection end and an open position providing access to the connection end. The provision of relatively movable cap and base portions permits access to the connection ends of the strings without demounting of the covers from the headstock.

According to another feature of the invention, the cover defines an opening providing passage for the associated string. This feature facilitates tuning of the instrument with the covers in closed positions.

According to a further feature, the cover has a hinge portion connecting the cap portion to the base portion. The hinge portion allows opening of the cap portion while preventing misplacement thereof.

According to an additional feature, the base portion defines the opening. This feature facilitates molding of the cover as an integral unit.

According to yet a further feature, the headstock defines a plurality of holes each receiving one of the stems, and each base portion includes an annular fastener portion received by the hole and surrounding the stem. This feature facilitates assembly of the instrument.

According to still additional features, each cap portion defines an inwardly projecting cylindrical portion arranged to receive the connection end with the cap in its closed position and also defines an engagement surface, and each base portion defines a contact surface projecting from the headstock and fittedly engaging the engagement surface with the cap in its closed position. During closure of the cover, the contact and engagement surfaces guide the cylindrical portion onto engagement with the stem thereby securing the cap in its closed position.

According to further useful features, each hole in the headstock defines a shoulder surface formed by a counterbore, and the annular fastener portion is formed by a plurality of flexible legs each defining a locking tab portion for engaging the shoulder surface. This feature simplifies assembly of the cover by latching the cover to the tuning mechanism.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
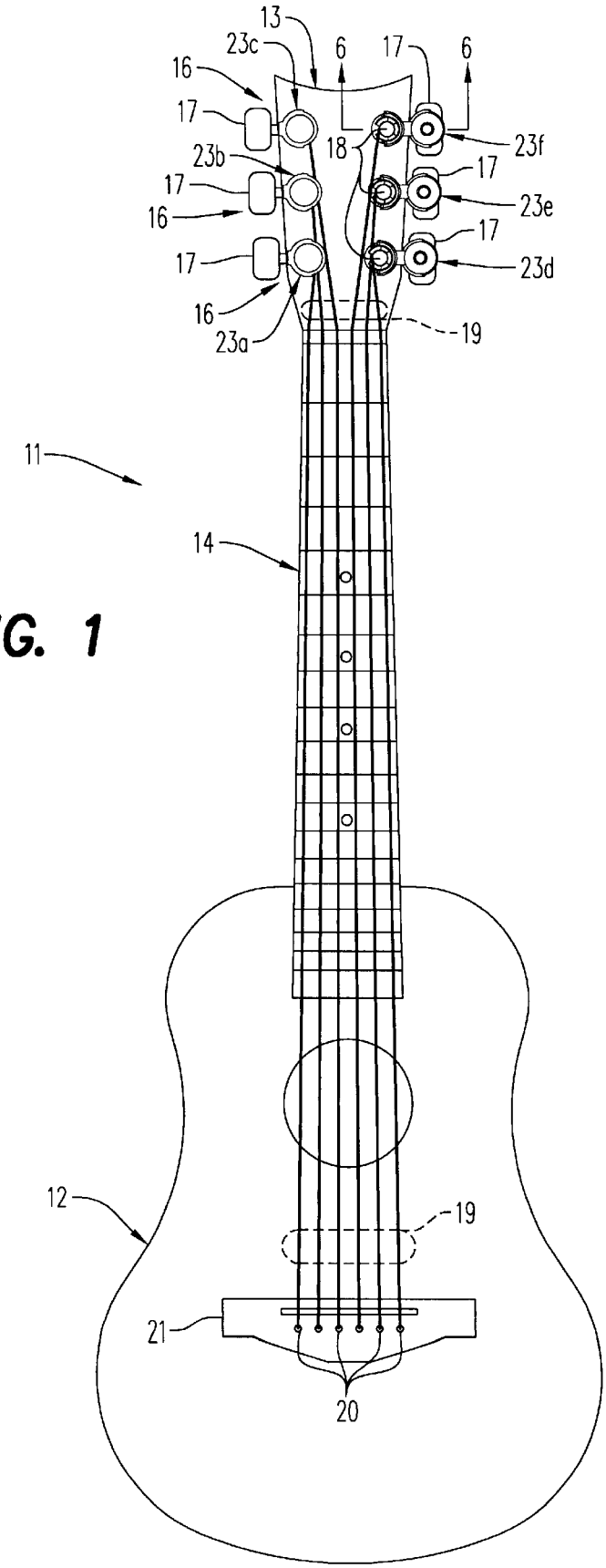
FIG. 1 is a plan view of a string instrument according to the invention.
Figure 4:
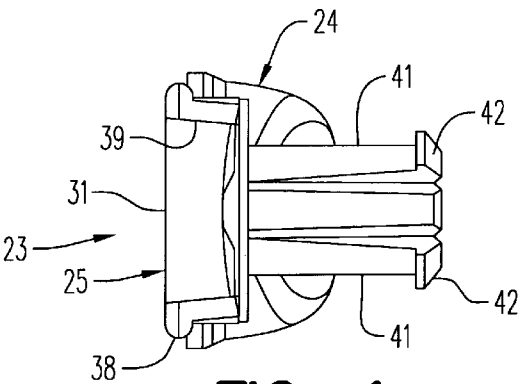
FIG. 4 is a right side view of the cover shown in FIG. 2.
Figure 2:
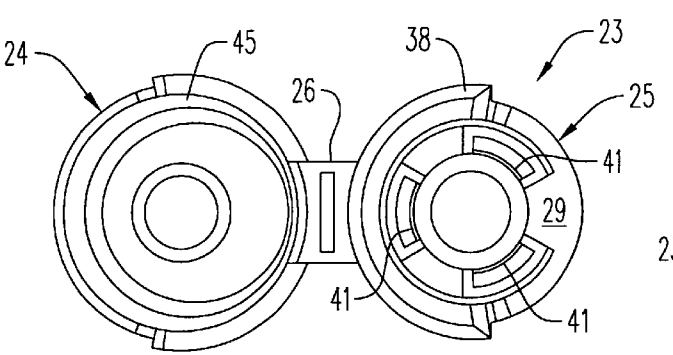
FIG. 2 is a plan view of a string cover used with the instrument of FIG. 1 and shown in an open position.
Figure 3:
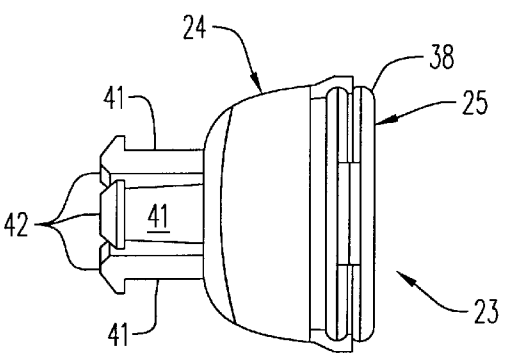
FIG. 3 is a left side view of the cover shown in FIG. 2.
Figure 5:
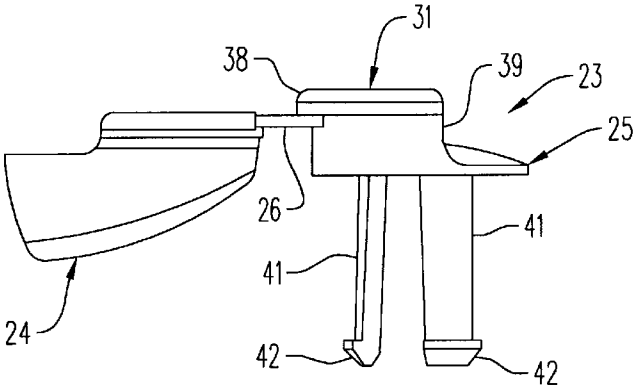
FIG. 5 is a rear view of the cover shown in FIG. 2.

A string guitar instrument 11 according to the invention is illustrated in FIG. 1. Included in the guitar 11 is a body 12 and a headstock 13 joined by a neck 14. A plurality of conventional tuning mechanisms 16 are mounted in the headstock 13. Each tuning mechanism includes a tuning knob 17 and a tuning stem 18 projecting through the headstock 13. A conventional tuning gear assembly (not shown) is operably coupled between each knob 17 and each stem 18. Extending between the body 12 and the headstock 13 are a plurality of strings 19 each having one end 20 connected to a support 21 on the body 12 and an opposite end connected to a different one of the tuning stems 18. Also included with the guitar 11 are a plurality of accessory covers 23*a*–23*f*, each mounted on the headstock 13. The covers 23*a*–23*c* are shown in a closed position and the covers 23*d*–23*f* are shown in an open position.

Figure 6:
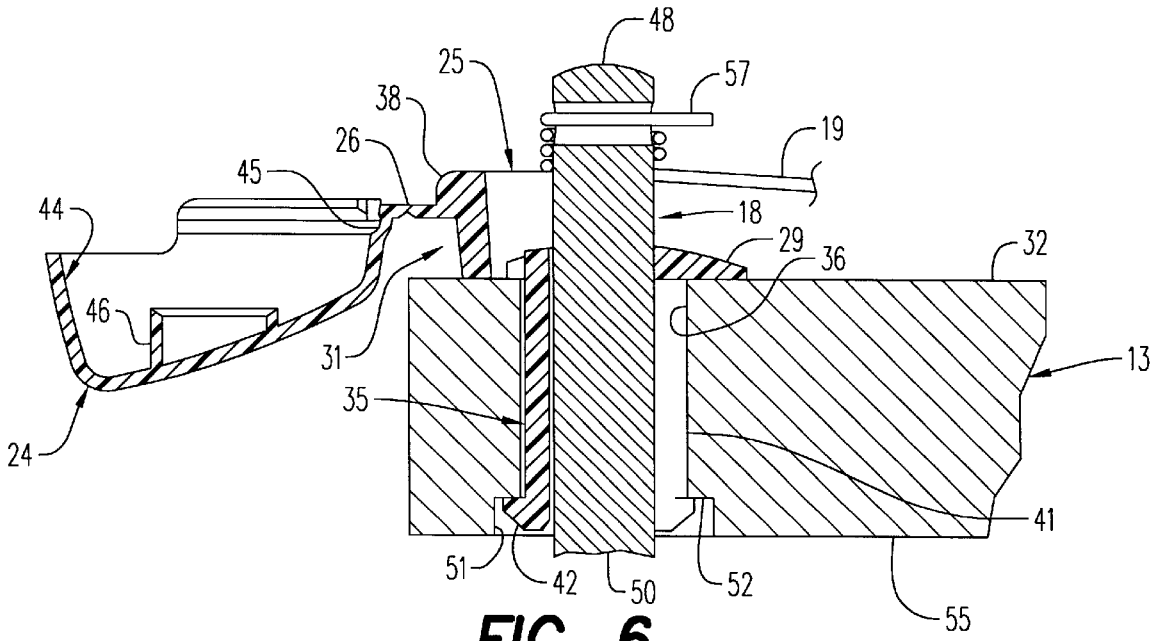
FIG. 6 is a sectional view taken along lines 6—6 of FIG. 1.
Figure 7:
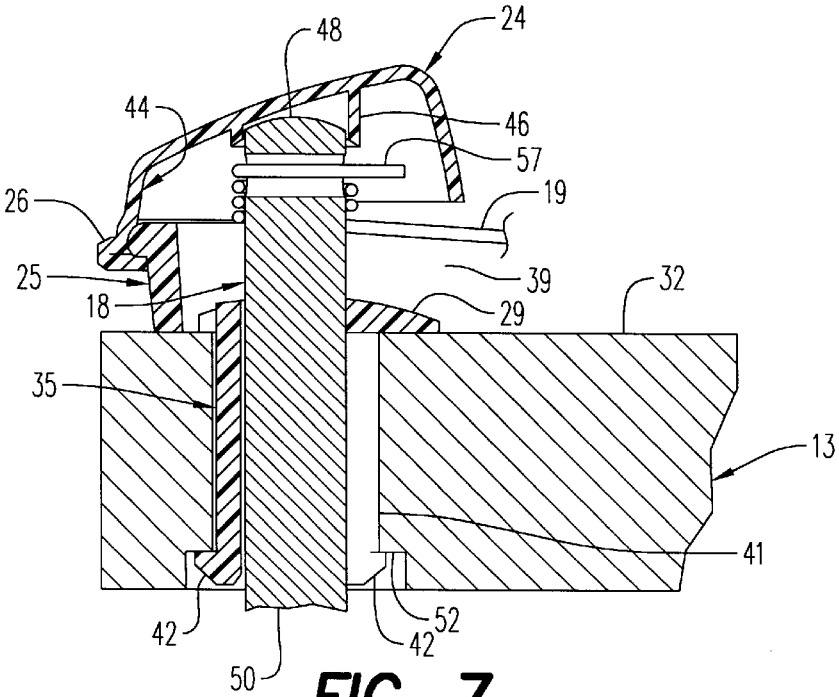
FIG. 7 is a cross-sectional view similar to that shown in FIG. 6 but with the cover shown in a closed position.
Figure 8:
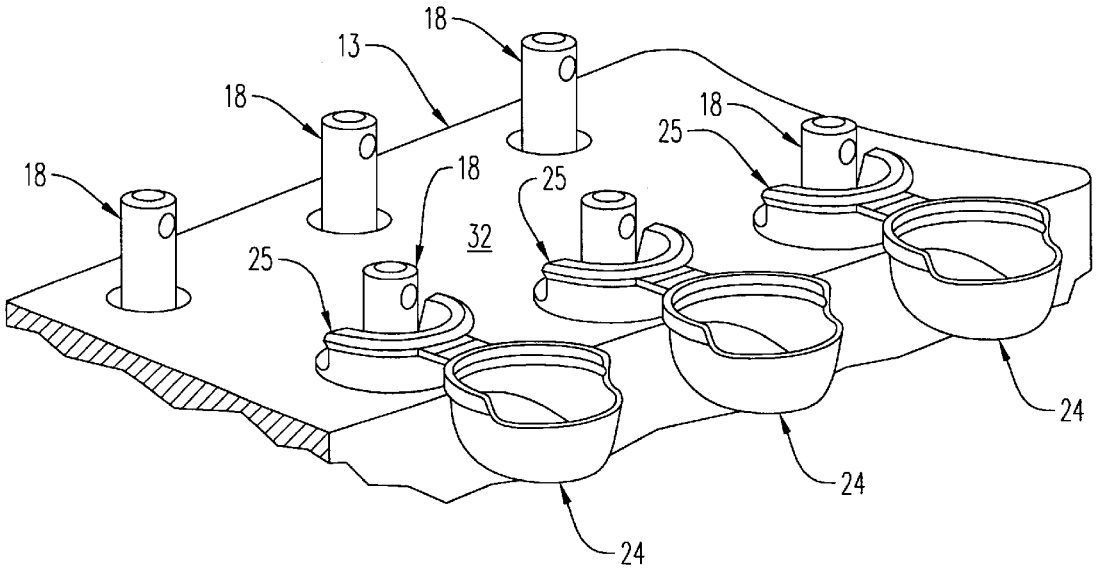
FIG. 8 is a partial perspective view of a headstock of the instrument of FIG. 1 and showing three tuning stems without covers and three tuning stems provided with covers in an open position.
Figure 9:
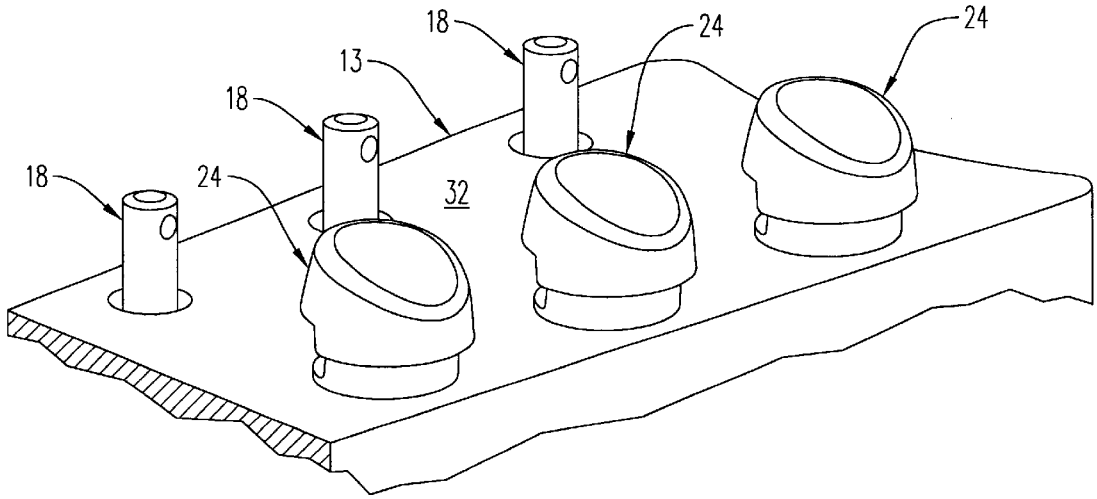
FIG. 9 is a perspective view similar to that shown in FIG. 8 but with the string covers depicted in closed positions.

Each cover 23 includes a cap portion 24 and a base portion 25 joined by a living hinge portion 26 as illustrated in FIGS. 2–7. The base portion 25 consists of a semi-cylindrical portion 31, an annular central portion 29 for mounting on a top surface 32 of the headstock 13, and an annular fastener portion 35 extending below the central portion 29 and received by a hole 36 in the headstock 13 (FIGS. 6 and 7). Defined by the semi-cylindrical portion 31 is an upwardly projecting bead forming an arcuate contact surface 38 and an opening 39 projecting transversely therefrom. The fastener portion 35 includes three flexible legs 41 having upper ends connected to the semi-cylindrical portion 31 and bottom ends defining outwardly projecting locking tabs 42.

The cap portion 24 is in the form of a cup 44 with an upper rim defining an arcuate engagement surface 45 shaped to fittedly engage the arcuate contact surface 38 on the semi-cylindrical portion 31. Also defined by the cup shaped cap portion 24 is an inwardly projecting cylindrical portion 46 shaped to fittedly engage a connection end 48 of the tuning stem 18 as shown in FIG. 7.

During assembly of the guitar 11, the fastener portions 35 of the covers 23 are inserted into the holes 36 in the headstock 13 as shown in FIG. 6. During insertion, the flexible legs 41 are flexed inwardly until the locking tabs 42 reach a counterbore 51 in the hole 36. At that point, the locking tabs 42 spring outwardly and engage a shoulder surface 52 formed by the counterbore 51 and thereby secure the cover 23 in position on the headstock 13. Next, the tuning mechanisms 16 are installed by inserting a tuning stem 18 upwardly through each annular fastener portion 35. A conventional gear assembly (not shown) coupled to a tuning end 50 of the tuning stem 18 then is fixed to a lower surface 55 of the headstock 13 by conventional means (not shown).

Prior to use of the guitar 11, opposite ends 57 of each string 19 is wound around a stem 18 and inserted through an aperture 58 in a connection end 48 of the stem 18 with its cap 24 in the open position depicted in FIG. 6. The tuning knobs 27 then are actuated to produce rotation of the stems 18 and tightly wind the opposite ends 57 of the strings 19 around the connection ends 48. After securement of each opposite end 57, the associated cap portion 24 of the associated cover 23 is pivoted into the closed position shown in FIG. 7. The cap portion 24 is retained in the closed position by the frictional engagement between the arcuate contact and engagement surfaces 38, 45 and between the cylindrical portion 46 and connection end 48 of the stem 18. Closure of the cap portion 24 is facilitated by the opening 39 in the base portion 25 which allows passage of the string 19. However, the closed cap portion 24 prevents physical access to the free opposite end 57 of the string 19. Subsequent fine tuning of the guitar 11 by rotation of the tuning knobs 17 is not hindered by the closed cover 23.

Obviously, many modifications and variations of the present invention are possible in light of the above teachings. It is to be understood, therefore, that the invention can be practiced otherwise than as specifically described.

What is claimed is:

1. A string instrument comprising:

a body;

a headstock;

a neck extending between said body and said headstock;

a plurality of tuning mechanisms retained by said headstock, each said tuning mechanism comprising a stem having a tuning end and a connection end;

a plurality of strings each having one end connected to said body and an opposite end connected to a different said connection end; and a plurality of cover means, each cover means covering a different said connection end and shaped and arranged to prevent physical access to said opposite end connected thereto.

2. A string instrument according to claim 1 wherein each said cover means comprises a base portion secured to said headstock, and a cap portion movable relative to said base portion between a closed position covering said connection end and an open position providing access to said connection end.

3. A string instrument according to claim 2 wherein with said cap portion in said closed position each said cover means defines an opening providing passage for said string.

4. A string instrument according to claim 3 wherein said cover means further comprises a hinge portion connecting said cap portion to said base portion.

5. A string instrument according to claim 4 wherein said base portion defines said opening.

6. A string instrument according to claim 3 wherein said headstock defines a plurality of holes each receiving one of said stems, and each said base portion includes an annular fastener portion received by said hole and surrounding said stem.

7. A string instrument according to claim 6 wherein each said cap portion defines an engagement surface, and each said base portion further defines a contact surface projecting from said headstock and fittedly engaging said engagement surface with said cap in said closed position.

8. A string instrument according to claim 7 wherein each said cap portion further defines an inwardly projecting cylindrical portion arranged to receive said connection end with said cap in said closed position.

9. A string instrument according to claim 8 wherein each said hole defines a shoulder surface formed by a counterbore, and said annular fastener portion is formed by a plurality of flexible legs each defining a locking tab portion for engaging said shoulder surface.

10. A string instrument according to claim 6 wherein said cover means further comprises a hinge portion connecting said cap portion to said base portion.

11. A string instrument according to claim 10 wherein said headstock defines a plurality of holes each receiving one of said stems, and each said base portion includes an annular fastener portion received by said hole and surrounding said stem.

12. A string instrument according to claim 11 wherein each said cap portion defines an engagement surface, and each said base portion further defines a contact surface projecting from said headstock and fittedly engaging said engagement surface with said cap in said closed position.

13. A string instrument according to claim 12 wherein each said cap portion further defines an inwardly projecting cylindrical portion arranged to receive said connection end with said cap in said closed position.

14. A string instrument according to claim 13 wherein each said hole defines a shoulder surface formed by a counterbore, and said annular fastener portion is formed by a plurality of flexible legs each defining a locking tab portion for engaging said shoulder surface.

15. A string instrument according to claim 4 wherein said cover means is an integrally molded unit.

16. An accessory for a string instrument having a body; a headstock; a neck extending between the body and the headstock; a plurality of tuning mechanisms retained by the headstock and each having a stem with a tuning end and a connection end, and, a string having one end connected to the body and an opposite end connected to each connection end; said accessory comprising:

a plurality of cover means each for covering a different one of the connection ends and being shaped and arranged to prevent physical access to the opposite end of the string connected thereto; each said cover means comprising a base portion secured to said headstock, and a cap portion movable relative to said base portion between a closed position covering the connection end and an open position providing access to the connection end; and wherein with said cap portion in said closed position said cover means defines an opening for allowing passage of the string.

17. An accessory for a string instrument according to claim 16 wherein said cover means further comprises a hinge portion connecting said cap portion to said base portion.

18. An accessory for a string instrument according to claim 17 wherein said base portion defines said opening.

19. An accessory for a string instrument according to claim 18 wherein said base portion includes an annular fastener portion adapted to be received by a hole in the headstock and to surround the stem.

20. An accessory for a string instrument according to claim 19 wherein said cap portion defines an annular engagement surface, and said base portion further defines a contact surface adapted to project from the headstock and to fittedly engage said engagement surface with said cap in said closed position.

21. An accessory for a string instrument according to claim 20 wherein said cap portion further defines an inwardly projecting cylindrical portion arranged to receive the connection end with the cap in said closed positions.

22. A string instrument comprising:

a body;

a headstock;

a neck extending between said body and said headstock;

a plurality of tuning mechanisms retained by said headstock, each said tuning mechanism comprising a stem having a tuning end and a connection end;

a plurality of strings each having one end connected to said body and an opposite end connected to a different said connection end; and cover means covering each said connection end and shaped and arranged to prevent physical access to said opposite end connected thereto; said cover means comprising a base portion secured to said headstock, a cap portion movable relative to said base portion between a closed position covering said connection end and an open position providing access to said connection end, and a hinge portion connecting said cap portion to said base portion; and wherein with said cap portion in said closed position said cover means defines an opening providing passage for said string.

* * * * *